US007648262B2

(12) United States Patent
Tanaka

(10) Patent No.: US 7,648,262 B2
(45) Date of Patent: Jan. 19, 2010

(54) LAMP UNIT OF VEHICLE HEADLAMP

(75) Inventor: Hidetada Tanaka, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/762,115

(22) Filed: Jun. 13, 2007

(65) Prior Publication Data

US 2007/0291499 A1 Dec. 20, 2007

(30) Foreign Application Priority Data

Jun. 16, 2006 (JP) ..... P. 2006-167595

(51) Int. Cl.
*F21V 7/00* (2006.01)
*F21V 5/00* (2006.01)
*F21V 1/00* (2006.01)

(52) U.S. Cl. ..... 362/509; 362/507; 362/520; 362/521; 362/522; 362/538; 362/545; 362/309; 362/310; 362/326; 362/327; 362/329; 362/334; 362/335; 359/720

(58) Field of Classification Search ..... 362/520–522, 362/545, 538, 334–336, 338, 309, 310, 326–327, 362/329, 507, 509; 359/720
See application file for complete search history.

(56) References Cited

U.S. PATENT DOCUMENTS 2,084,254 A * 6/1937 Hoal ..... 362/327
7,357,545 B2 * 4/2008 Stefka et al. ..... 362/539
2004/0105275 A1 * 6/2004 Sazuka et al. ..... 362/507

FOREIGN PATENT DOCUMENTS

JP 2005044683 A 2/2005
JP 2005108555 A 4/2005

* cited by examiner

*Primary Examiner*—Sharon E Payne
*Assistant Examiner*—Sean P Gramling
(74) *Attorney, Agent, or Firm*—Sughrue Mion, PLLC

(57) ABSTRACT

By a convex lens arranged on an optical axis extending in a front and rear direction of a lamp unit, direct light from a light emitting element arranged rearward of the convex lens is deflected to emit so that the light is made to be parallel light in a vertical face and diffused light toward left and right sides in a horizontal face. An entire region of a left side lens region of the convex lens is constituted as upper deflecting regions for deflecting light to a direction upward with respect to a direction of light of a right side lens region. Light emitted to the front side by transmitting the respective upper deflecting regions is made to be light directed upward from light emitted from the right side lens region to thereby form a laterally elongated light distribution pattern in which an upper end edge of a portion of being disposed on a left side relative to the optical axis is stepped up from an upper end edge of a portion thereof disposed on a right side.

11 Claims, 11 Drawing Sheets

LAMP UNIT OF VEHICLE HEADLAMP

This application claims foreign priority from Japanese Patent Application No. 2006-167595, filed on Jun. 16, 2006, the entire contents of which are hereby incorporated by reference.

BACKGROUND OF THE INVENTION

1. Field of the Invention

The present invention relates to a lamp unit of a vehicle headlamp configured to emit direct emitting light from a light source arranged rearward from a convex lens to deflect toward a front side by the convex lens arranged on an optical axis extending in a front and rear direction of the lamp unit.

2. Related Art

In a background art, as a lamp unit of a vehicle headlamp, as described, for example in JP-A-2005-044683, there is known a so-to-speak direct emitting type lamp unit for emitting direct light from a light source arranged rearward of a convex lens to deflect toward a front side by the convex lens arranged on an optical axis extending in a front and rear direction of the lamp unit.

Further, JP-A-2005-108555 describes such a direct emitting type lamp unit in which a convex lens thereof is constituted to emit direct light from a light source as substantially parallel light in a vertical face and emit the direct light as light diffused to left and right sides in a horizontal face.

By adopting the lamp unit of JP-A-2005-108555, a laterally elongated light distribution pattern can be formed. When the laterally elongated light distribution pattern is formed at a vicinity of a lower side of a cutoff line in a light distribution pattern for a low beam, a road face on a front side of a vehicle can be irradiated widely in a width thereof.

However, even when such a constitution is adopted, the following problem is posed.

That is, in order to be able to ensure a front optical recognizability of a driver of a vehicle without casting glare to a driver running on an opposed lane in the low beam, the cutoff line of the light distribution pattern for the low beam is formed such that a cutoff line on a side of own lane is stepped up or extended in a skewed upper direction relative to a cutoff line on a side of the opposed lane. Therefore, by only forming the laterally elongated light distribution pattern simply at the vicinity of the lower side of the cutoff line of the light distribution pattern for the low beam, although the vehicle front side road face can be irradiated widely in the width, a region on a side of the own lane cannot be irradiated remotely. Therefore, there poses a problem that a remote optical recognizability cannot sufficiently be promoted by the low beam.

SUMMARY OF THE INVENTION

One or more embodiments of the present invention provide a lamp unit capable of sufficiently promoting a remote optical recognizability by a low beam by irradiating light thereof even when a direct emitting type lamp unit is adopted as a lamp unit of a vehicle headlamp, by devising a shape of a convex lens.

In accordance with one or more embodiments of the present invention, a lamp unit of a vehicle headlamp is provided with: a convex lens arranged on an optical axis extending in a front and rear direction of the lamp unit; and a light source arranged rearward from the convex lens, wherein direct emitting light from the light source to the convex lens is emitted toward a front side of the lamp unit. In the lamp unit, the convex lens is configured to emit the light from the light source as substantially parallel light in a vertical face and emit as light diffused to left and right sides in a horizontal face. In the lamp unit, the convex lens comprises a pair of lens regions on left and right sides of the optical axis of the convex lens, and at least a partial region of one lens region of the lens regions is configured as an upper deflecting region that deflects the light from the light source in an upper direction with respect to a direction of light emitted from the other lens region.

The 'optical axis' may coincide with an axis line extended in the front and rear direction of the vehicle or may not coincide therewith so far as axis line is an axis line extended in the front and rear direction of the lamp unit.

A kind of the 'light source' is not particularly limited but, for example, the light emitting element of a light emitting diode, a laser diode or the like, or a discharge light emitting portion of a discharge bulb, a filament of a halogen bulb or the like can be adopted. Further, the 'light source' may be arranged on the optical axis, or may be arranged at a position deviated from the optical axis.

Although the 'upper deflecting region' is configured to deflect the light from the light source in the direction upper than the direction of the other lens region, a specific value of an upper deflecting amount thereof is not particularly limited but can be set to a value within a range of, for example, about 0.3 through 2° or 0.5 through 1.5°. Further, the 'upper deflecting region' may be constituted by any of setting a portion of a rear side surface of the convex lens to a surface shape different that of from other portion, or setting a portion of a surface on a front side of the convex lens to a surface shape different from that of other portion, or setting a portion of a rear side surface and a portion of a front side surface of the convex lens by a surface shape different from those of other portion.

As shown by the above-described constitution, according to the one or more embodiments of the present invention, in the lamp unit, by the convex lens arranged on the optical axis extended in the front and rear direction of the lamp unit, the direct emitting light from the light source arranged rearward therefrom is emitted to deflect to the front side, the direct emitting light is emitted as substantially parallel light in the vertical face and emitted as light diffused to the left and right sides in the horizontal face, and therefore, the laterally elongated light distribution pattern can be formed by light irradiated from the lamp unit.

Moreover, according to the lamp unit, in the pair of lens regions on the left and right sides of the optical axis of the convex lens, at least the partial region of the one lens region is constituted as the upper deflecting region for deflecting the light from the light source in the direction upward with respect to the direction of the other lens region. Therefore, light emitted to the front side by transmitting through the upper deflecting region becomes light in a direction upper than a direction of light emitted from the other lens region. Therefore, in the laterally elongated light distribution pattern formed by light irradiated from the lamp unit, the upper end edge of the portion disposed on the one lens region side relative to the optical axis is formed to step up with respect to the upper end edge of the portion disposed on the other lens region side.

Therefore, when the laterally elongated light distribution pattern is formed at a vicinity of the lower side of the cutoff line of the light distribution pattern for the low beam in a state in which the portion disposed on the one lens region side is disposed on the side of the cutoff line on the side of the own lane of the light distribution pattern for the low beam, the vehicle front side road face can widely irradiated in the width and the own lane side region also can be irradiated remotely.

In this way, according to the one or more embodiments of the present invention, even when the direct emitting type lamp unit is adopted as the lamp unit of the vehicle headlamp, the remote optical recognizability of the low beam can sufficiently be promoted by the irradiating light.

In the above-described constitution, when there is constructed the constitution of forming a boundary stepped portion partitioning the upper deflecting region and the other lens region on the rear side surface of the convex lens, the front side surface of the convex lens can be constituted by a smooth curve face. Thereby, the above-described operation and effect can be achieved without deteriorating a design performance of the lamp unit.

In addition, when the boundary stepped portion is formed to step up from the other lens region to the upper deflecting region, light from the light source incident on the boundary stepped portion can be deflected to the side of the one lens region relative to the optical axis. Thereby, it can be prevented beforehand that the light from the light source incident on the boundary stepped portion is emitted to a space at the vicinity of the upper side of the cutoff line on the side of the opposed lane. Thereby, a situation of casting glare light to a driver running on the opposed lane is prevented.

Moreover, when the light emitting element having the light emitting chip, the lower end edge of which is formed in the linear shape is used as the light source of the lamp unit, an upper end edge of the laterally elongated light distribution pattern can be formed by a high bright/dark ratio as an invertedly projected image of the lower edge of the light emitting chip. Therefore, the laterally elongated light distribution pattern can be formed to be proximate to the cutoff line of the light distribution pattern for the low beam. Thereby, the remote optical recognizability of the vehicle front side road face can further be promoted.

In addition, when the light emitting element is arranged such that the lower end edge of the light emitting chip is inclined from the other lens region to the one lens region in the upper direction by the predetermined angle, the stepped portion of the laterally elongated light distribution pattern can be formed as an inclined portion having the high bright/dark ratio as the invertedly projected image of the lower end edge of the light emitting chip. Thereby, the laterally elongated light distribution pattern can further be made to be proximate to the cutoff line of the light distribution pattern for the low beam.

Moreover, when the light emitting chip of the light emitting element is provided with a rectangular outer shape, the lower end edge can be formed to be long. Thereby, the invertedly projected image of the lower end edge can also be formed to be long.

Other aspects and advantages of the invention will be apparent from the following description and the appended claims.

BRIEF DESCRIPTION OF THE DRAWINGS

FIG. 4 (*b*) is a diagram perspectively showing a light distribution pattern for a low beam including the laterally elongated light distribution pattern at a portion thereof.

DETAILED DESCRIPTION OF THE EXEMPLARY EMBODIMENTS

Exemplary Embodiments of the invention will be explained in reference to the drawings.

A first exemplary embodiment of the invention will be explained.

Figure 1:
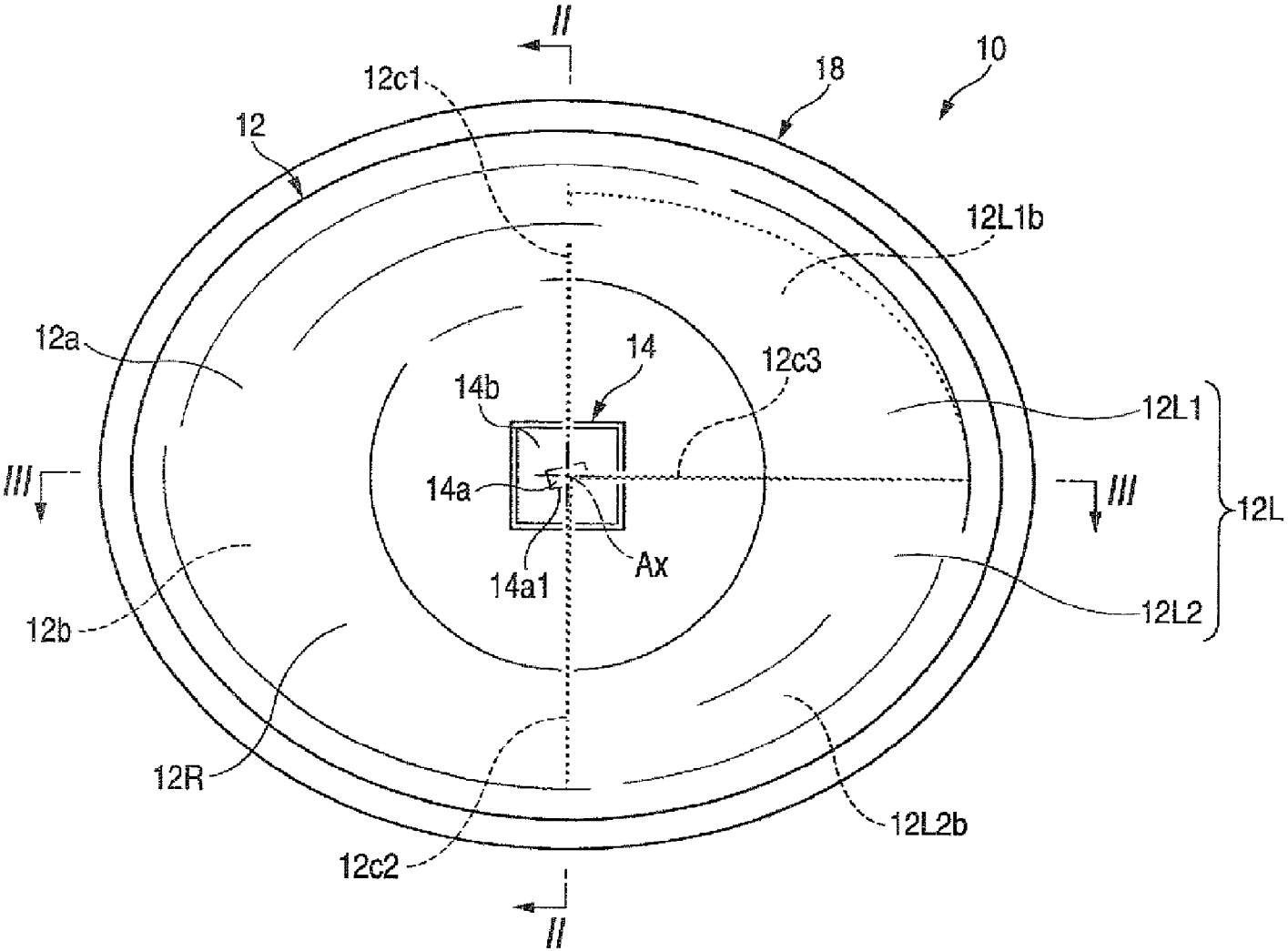
FIG. 1 is front view showing a lamp unit of a vehicle headlamp according to a first exemplary embodiment of the invention.
Figure 2:
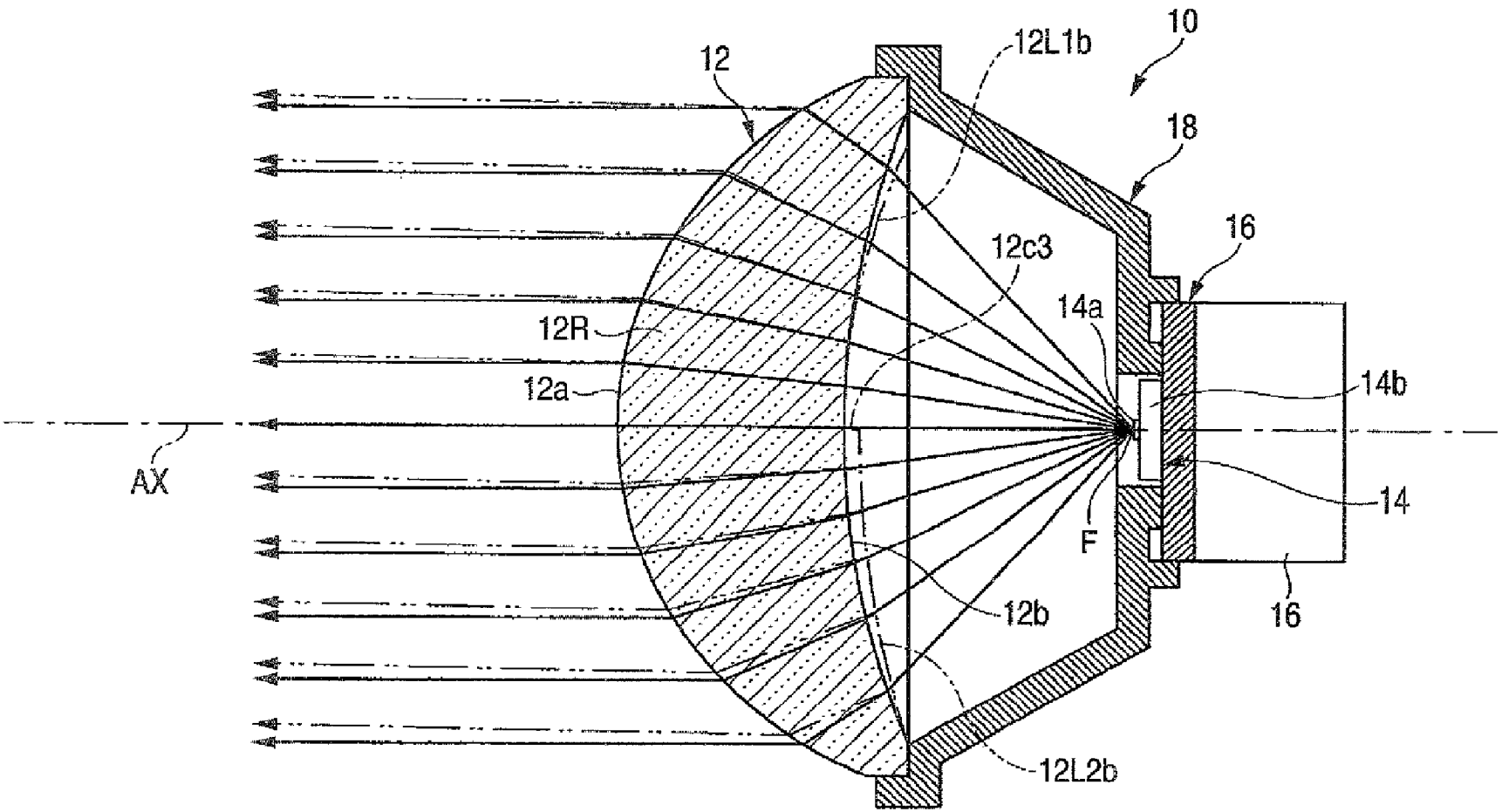
FIG. 2 is a sectional view taken along a line II-II of FIG. 1.
Figure 3:
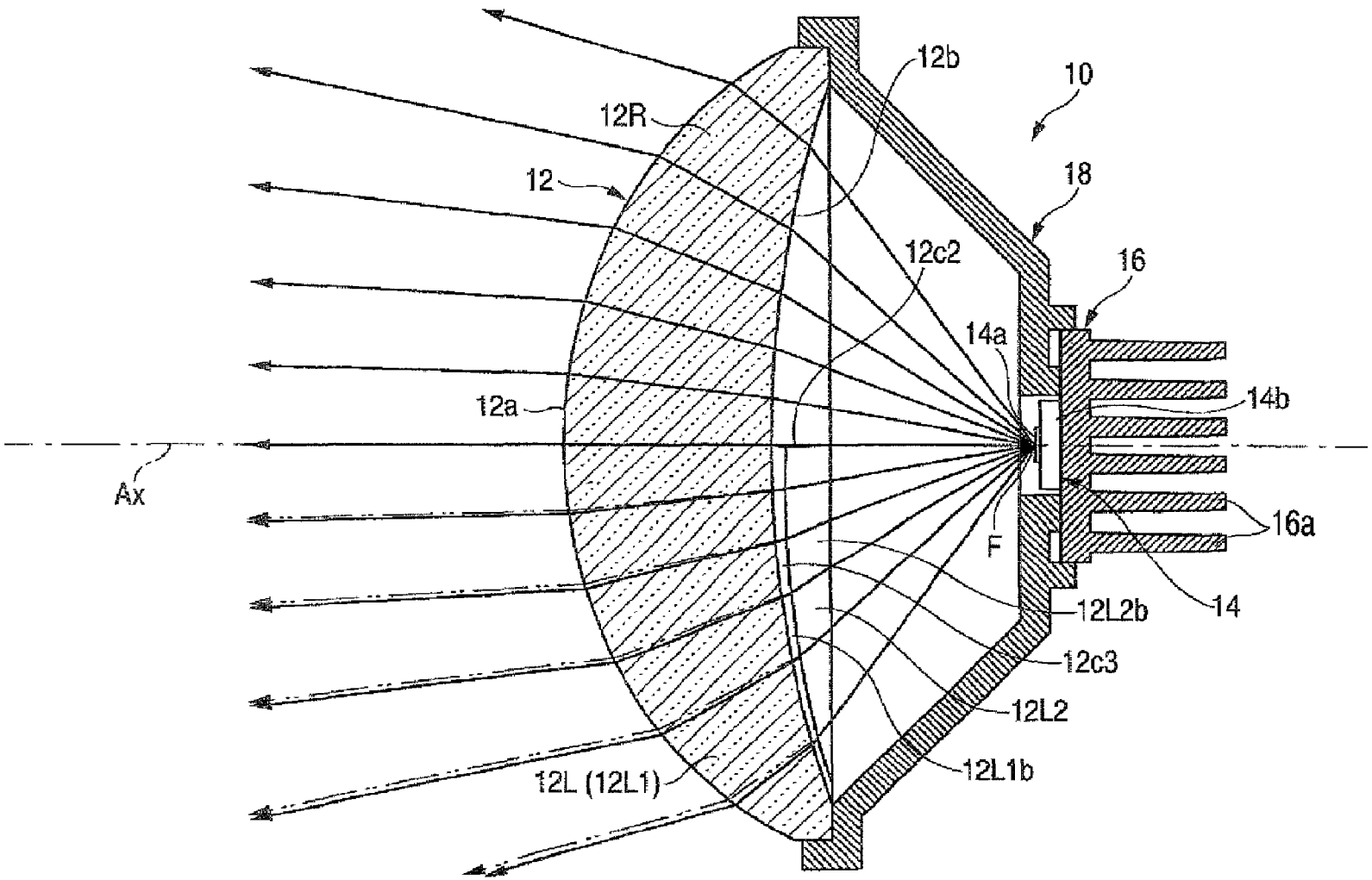
FIG. 3 is a sectional view taken along a line III-III of FIG. 1.

FIG. 1 is front view showing a lamp unit 10 of a vehicle headlamp according to the first exemplary embodiment. FIG. 2 is a sectional view taken along a line II-II of FIG. 1. FIG. 3 is a sectional view taken along a line III-III of FIG. 1.

As shown by the drawings, the lamp unit 10 according to the first exemplary embodiment is provided with a convex lens 12 arranged on an optical axis Ax extending in a front and rear direction of the lamp unit, a light emitting element 14 arranged rearward from the convex lens, a support plate 16 for fixedly supporting the light emitting element 14 in a state of being directed to a front side on the optical axis Ax, and a holder 18 connecting the support plate 16 and the convex lens 12. The lamp unit 10 is constituted as a lamp unit of a direct emitting type for emitting direct light from the light emitting element 14 to deflect to a front side by the convex lens 12.

The lamp unit 10 is used as a portion of a vehicle headlamp in a state of being integrated to a lamp body or the like, not illustrated. According to the lamp unit 10, the optical axis Ax is arranged to direct to a lower side by about 3° relative to an axis line extended in a front and rear direction of a vehicle to irradiate light for forming a laterally elongated light distribution pattern constituting a portion of a light distribution pattern for a low beam.

The light emitting element 14 is a white light emitting diode and comprises a light emitting chip 14*a* having a light emitting face of a shape of a rectangle of about 1×2 mm square, and a board 14*b* in a square shape supporting the light emitting chip 14*a*. The light emitting chip 14*a* is sealed by a thin film formed to cover the light emitting face. The light emitting chip 14*a* is mounted to the board 14*b* in a state of being rotated in the counterclockwise direction by 15° in a front view of the lamp unit.

The light emitting element 14 is fixedly supported by the support plate 16 in a state in which the board 14*b* is erected regularly by making a long side of the rectangle constituting an outer shape of the light emitting chip 14*a* disposed at a lower end edge 14*a*1 of the light emitting chip 14*a*, that is, in a state in which the lower end edge 14*a*1 of the light emitting chip 14*a* is arranged to extend in a right upper direction by 15° relative to the horizontal line in the front view of the lamp unit.

The support plate 16 is arranged along a vertical face orthogonal to the optical axis Ax, and a rear face thereof is formed with a plurality of heat discharge fins 16*a* extended in an up and down direction.

The convex lens 12 is a convex meniscus lens having a front side surface 12*a* in a convex face and a rear side surface 12*b* in a concave face for emitting light from the light emitting element 14 as parallel light in a vertical face and emitting the light as light diffused to left and right sides in a horizontal face.

In order to realize the constitution, a position of a rear side focal point F of the convex lens 12 in the vertical face is set to a light emitting center of the light emitting chip 14*a* of the light emitting element 14. A position of a rear side focal point in the horizontal face is set to a point on a rear side of the rear side focal point F on the optical axis Ax to some degree.

In a pair of lens regions 12L, 12R on left and right sides of the optical axis Ax of the convex lens 12, an entire region of the left side lens region 12L disposed on a left side (left side in front view of the lamp unit, the same as follows) is constituted as an upper deflecting region for deflecting light from the light emitting element 14 in a direction upward from a direction of the right side lens region 12R. The upper deflecting region includes an upper deflecting region 12L1 disposed on an upper side of the optical axis Ax and an upper deflecting region 12L2 disposed on a lower side of the optical axis Ax. An upper deflecting amount of emitted light from the respective upper deflecting regions 12L1, 12L2 is set to a value of about 0.8°.

In order to realize the constitution, portions of the rear side surface 12*b* of the convex lens 12 disposed at the respective upper deflecting regions 12L1, 12L2 are constituted by upper deflecting faces 12L1*b*, 12L2*b* having surface shapes different from the other general face. Further, boundary stepped portions 12*c*1, 12*c*2 for partitioning the respective upper deflecting regions 12L1, 12L2 and the right side lens region 12R are formed between the respective upper deflecting faces 12L1*b*, 12L2*b* and the general face. Further, a boundary stepped portion 12*c*3 for portioning the upper deflecting region 12L1 and the upper deflecting region 12L2 is formed also between the respective upper deflecting faces 12L1*b*, 12L2*b*.

In this case, the respective boundary stepped portion 12*c*1, 12*c*2 are formed to step up from the right side lens region 12R to the respective upper deflecting regions 12L1, 12L2. Further, the boundary stepped portion 12*c*3 is formed to step up from the upper deflecting region 12L1 to the upper deflecting region 12L2.

Light from the light emitting element 14 incident on the right side lens region 12R of the convex lens 12 is emitted to a front side as light in parallel with the optical axis Ax in a vertical face as shown by a bold line in FIG. 2, and emitted as light diffused in a right direction relative to the optical axis Ax in a horizontal face as shown by a bold line in FIG. 3.

On the other hand, light from the light emitting element 14 incident on the respective upper deflecting regions 12L1, 12L2 constituting the left side lens region 12L of the convex lens 12 is emitted to a front side as parallel light in an upper direction by about 0.8° relative to the optical axis Ax as shown by a two-dotted chain line in FIG. 2, and emitted to the front side as light diffused in a left direction relative to the optical axis Ax in a horizontal face as shown by a bold line and a two-dotted chain line in FIG. 3.

Figure 4:
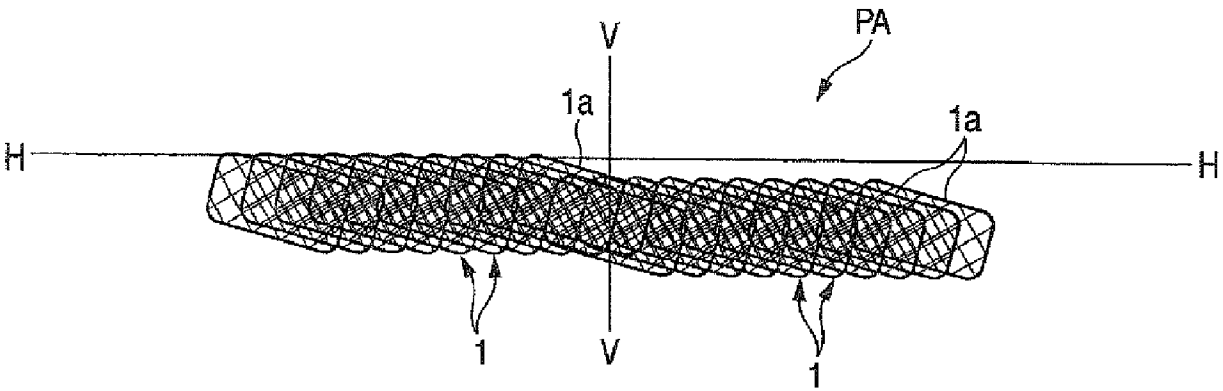
FIG. 4 (*a*) is a diagram showing a laterally elongated light distribution pattern formed on an imaginary vertical screen arranged at a position of 25 m frontward from the lamp by light irradiated to a front side from the lamp unit according to the first exemplary embodiment.
Figure 4:
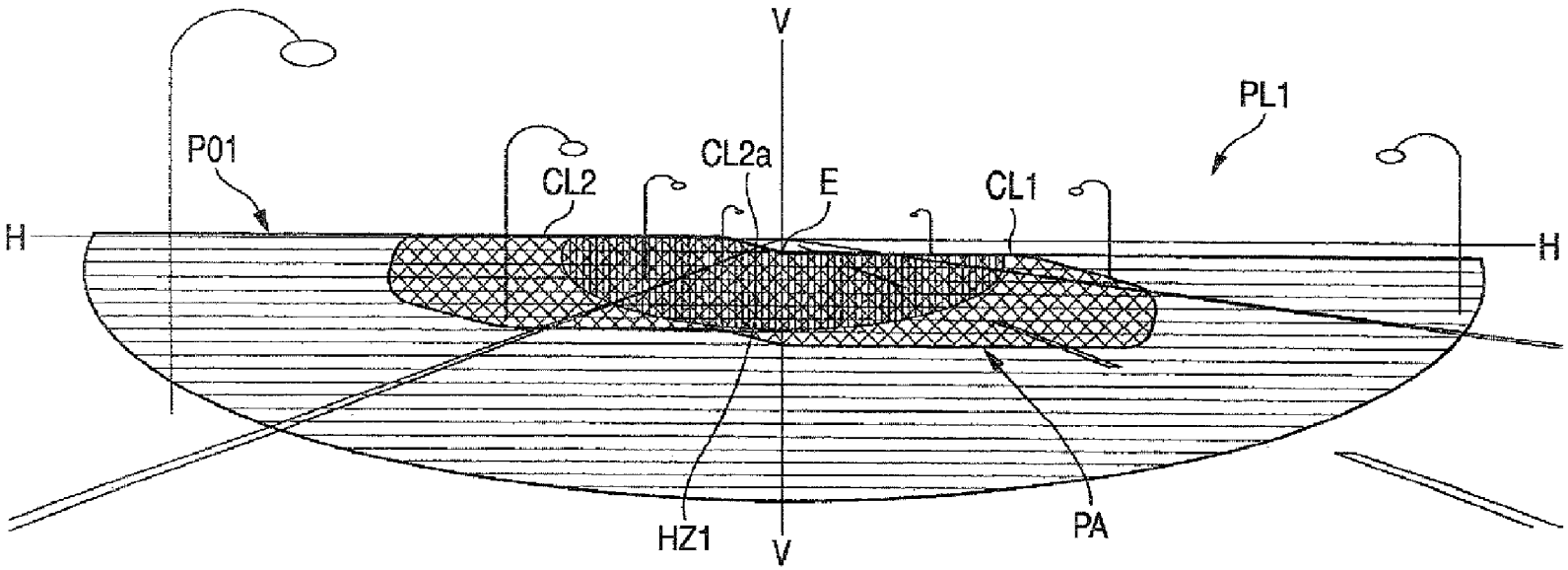

FIG. 4 (*a*) is a diagram showing a laterally elongated light distribution pattern PA by light irradiated to the front side from the lamp unit 10 according to the embodiment on an imaginary vertical screen arranged at a position of 25 m frontward from the lamp, FIG. 4 (*b*) is a diagram perspectively showing a light distribution pattern PL1 for a low beam partially including the laterally elongated light distribution pattern PA.

As shown by FIG. 4 (*b*), the light distribution pattern PL1 for the low beam is a light distribution pattern for the low beam of a left light distribution, and is formed as the light distribution pattern synthesized with a basic light distribution pattern P01 and the laterally elongated light distribution pattern PA.

The basic light distribution pattern P01 is a light distribution pattern formed by light irradiated from a projector type lamp unit, not illustrated, for forming a basic shape of the light distribution pattern PL1 for the low beam having cutoff lines CL1, CL2 at an upper end portion thereof.

According to the cutoff lines CL1, CL2, the opposed lane side cutoff line CL1 is formed to extend horizontally on a slightly lower side of H-H line (horizontal line passing H-V constituting a vanishing point in a direction of a front face of a vehicle), the own lane side cutoff line CL2 is formed to rise skewedly from the opposed lane side cutoff line CL1 to a vicinity of an upper side of the H-H line to thereafter extended horizontally. In this case, a rise angle of a skewed rise portion CL2*a* of the own lane side cutoff line CL2 is set to 15°.

In the basic light distribution pattern P01, a position of an elbow point E constituting an intersection of the opposed lane side cutoff line CL1 and the skewed rise portion CL2*a* of the own lane side cutoff line CL2 is set to position on a lower side of H-V by about 0.5 through 0.6°, and a hot zone HZ1 constituting a high illuminance region is formed to surround the elbow point E.

The laterally elongated light distribution pattern PA is formed to slenderly extended to left and right sides centering on V-V line constituting a vertical line passing H-V, and an upper end edge thereof is extended along the cutoff lines CL1, CL2. Further, by additionally forming the laterally elongated light distribution pattern PA to the basic light distribution pattern P01, brightnesses of the hot zone HZ1 and the two left and right side portions are reinforced.

As shown by FIG. 4 (*a*), the laterally elongated light distribution pattern PA is provided with a shape of expanding a light source image (that is, an invertedly projected image of the light emitting chip 14*a* of the light emitting element 14) I invertedly projected by the convex lens 12 in a left and right direction.

In this case, a portion of the laterally elongated light distribution pattern PA disposed on a left side of a portion thereof disposed on a right side of the V-V line is displaced to an upper side by about 0.8°, this is because light emitted from the left side lens region 12L of the convex lens 12 is directed in a direction upward from a direction of light emitted from the right side lens region 12R by about 0.8°.

Further, each light source image I is formed in a state in which an upper end edge Ia is inclined to extend to a left upper side by 15°, this is because the light emitting chip 14*a* is arranged in a state in which the lower end edge 14*a*1 comprising the long side of the rectangular shape is inclined to extend to a left upper side by 15°.

Further, the upper end edge Ia of the light source image I constituting a right end portion of a portion of the laterally elongated light distribution pattern PA disposed on the left side of the V-V line is formed as an invertedly projected image of the lower end edge 14*a*1 of the light emitting chip 14*a*, and therefore, provided with a high bright/dark ratio. Further, as shown by FIG. 4 (*b*), by making the upper end edge Ia of the light source image I substantially coincide with the skewed rise portion CL2*a* of the own lane side cutoff line CL2, a brightness of a region at a vicinity of the elbow point E of the hot zone HZ is sufficiently reinforced by the laterally elongated light distribution pattern PA.

As described above in details, according to the lamp unit 10 of the vehicle headlamp according to the first exemplary embodiment, by the convex lens 12 arranged on the optical axis Ax extended in the front and rear direction of the lamp unit, direct light from the light emitting element 14 arranged rearward therefrom is emitted to deflect to the front side, the light is emitted as parallel light in the vertical face and emitted as light diffused to the left and right sides in the horizontal face. Therefore, the laterally elongated light distribution pattern PA can be formed by the light irradiated from the lamp unit 10.

In this case, according to the lamp unit 10, the entire region of the left side lens region 12L of the convex lens 12 is constituted as the upper deflecting regions 12L1, 12L2 for deflecting light from the light emitting element 14 in the direction upward from the direction of the right side lens region 12R. Therefore, light emitted to the front side by transmitting the respective upper deflecting regions 12L1, 12L2 becomes light directed in the direction upward from the direction of the light emitted from the right side lens region 12R. Therefore, the upper end edge of the portion of the laterally elongated light distribution pattern PA formed by light irradiated from the lamp unit 10 disposed on the left side relative to the optical axis Ax is formed to step up in comparison with the upper end edge of the portion disposed on the right side.

Further, according to the first exemplary embodiment, the laterally elongated light distribution pattern PA is formed as a portion of the light distribution pattern PL1 for the low beam of the left light distribution, and at that occasion. The laterally elongated light distribution pattern PA is formed at vicinities of lower sides of the cutoff lines CL1, CL2 in a state in which the portion disposed on the left side is disposed on the side of the own lane side cutoff line CL2. Therefore, after irradiating the vehicle front side road face widely in the width, the own lane side region can remotely be irradiated. Thereby, the remote optical recognizability by the low beam can sufficiently be promoted.

Further, according to the first exemplary embodiment, the rear side surface 12*b* of the convex lens 12 is formed with the boundary stepped portions 12*c*1, 12*c*2 partitioning the upper deflecting regions 12L1, 12L2 and the right side lens region 12R and the boundary stepped portion 12*c*3 partitioning the upper deflecting region 12L1 and the upper deflecting region 12L2. Therefore, the front side surface of the convex lens 12 can be constituted by the smooth curve face. Thereby, the above-described operation and effect can be achieved without deteriorating the design performance of the lamp unit 10.

Further, according to the first exemplary embodiment, the respective boundary stepped portions 12*c*1, 12*c*2 are formed to step up from the right side lens region 12R to the respective upper deflecting regions 12L1, 12L2. Therefore, light from the light emitting element 14 incident on the respective boundary stepped portions 12*c*1, 12*c*2 can be deflected to the left direction. Thereby, it can be prevented beforehand that a situation in which light from the light emitting element 14 incident on the respective boundary stepped portions 12*c*1, 12*c*2 is emitted to the upper side of the opposed lane side cutoff line CL1 cast glare light to the opposed vehicle driver is brought about.

Further, according to the first exemplary embodiment, the boundary stepped portion 12*c*3 is formed to step up from the upper deflecting region 12L1 disposed on the upper side of the optical axis Ax to the upper deflecting region 12L2 disposed on the lower side. Therefore, light from the light emitting element 14 incident on the boundary stepped portion 12*c*3 can be deflected in the lower direction. Thereby, it can be prevented beforehand that a situation in which light from the light emitting element 14 incident on the boundary stepped portion 12*c*3 is emitted to an upper space of the own lane side cutoff line CL2 to cast glare light to a walker or the like is brought about.

Further, according to the first exemplary embodiment, as the light source of the lamp unit 10, the light emitting element 14 having the light emitting chip 14*a* formed linearly at the lower end edge 14*a*1 is used. Therefore, the upper end edge of the laterally elongated light distribution pattern PA can be formed by the high bright/dark ratio as the invertedly projected image Ia of the lower end edge 14*a*1 of the light emitting chip 14*a*. Thereby, the laterally elongated light distribution pattern PA can be formed to be proximate to the cutoff lines CL1, CL2 of the light distribution pattern PL1 for the low beam. Therefore, the remote optical recognizability of the vehicle frontward face can further be promoted.

Particularly, according to the first exemplary embodiment, the light emitting element 14 is arranged such that the lower end edge 14*a*1 of the light emitting chip 14*a* is inclined in the upper direction by 15° from the right side lens region 12R to the left side lens region 12L. Therefore, the stepped portion of the laterally elongated light distribution pattern PA can be formed as the inclined portion having the high bright/dark ratio by the upper end edge Ia of the light source image I constituting the invertedly projected image of the lower end edge 14*a*1 of the light emitting chip 14*a*. Further, according to the laterally elongated light distribution pattern PA, the upper end edge Ia of the light source image I constituting the inclined portion is formed to substantially coincide with the skewed rise portion CL2*a* of the own lane side cutoff line CL2. Therefore, the brightness of the region at the vicinity of the elbow point E of the hot zone HZ1 can sufficiently be reinforced. Thereby, the remote optical recognizability of the own lane side region of the vehicle front road face can further be promoted.

Further, according to the first exemplary embodiment, the light emitting chip 14*a* of the light emitting element 14 is provided with the rectangular outer shape, the lower end edge 14*a*1 is formed to be long. Therefore, also the upper end edge Ia of the light source image I constituting the invertedly projected image of the lower end edge 14*a*1 can be formed to be long. Thereby, the length of the stepped portion inclined in the upper direction by 15° in the laterally elongated light distribution pattern PA can sufficiently be ensured.

Figure 5:
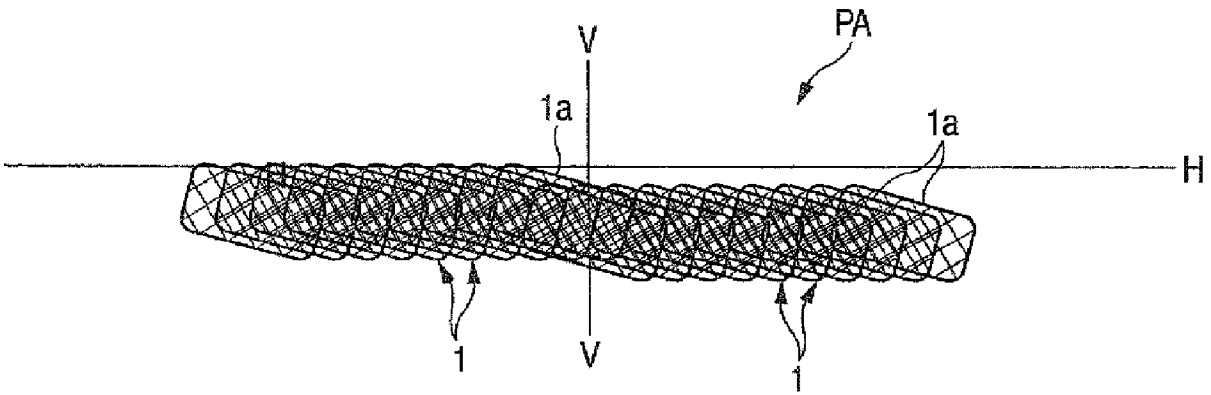
FIG. 5 (*a*) is a view similar to FIG. 4 (*a*) showing the laterally elongated light distribution pattern, and FIG. 5 (*b*) is a diagram perspectively showing a light distribution pattern for a low beam including the laterally elongated light distribution pattern at a portion thereof.
Figure 5:
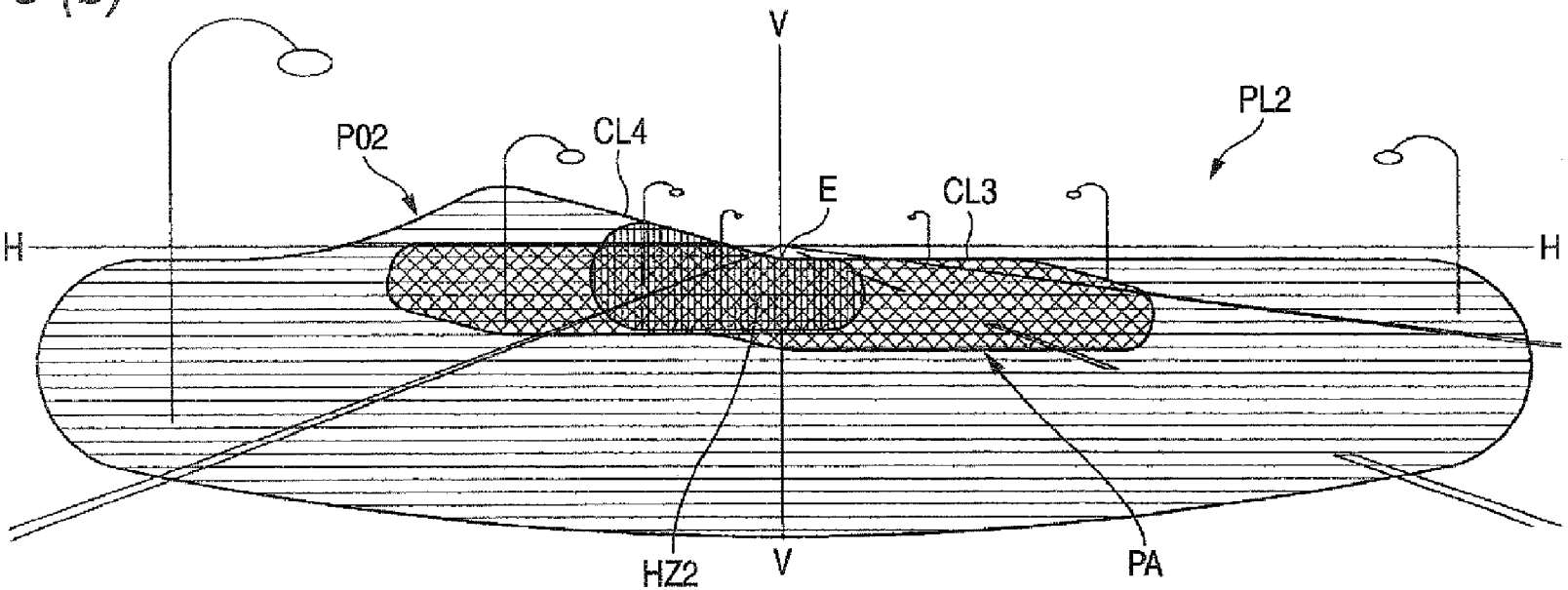

According to the first exemplary embodiment, although an explanation has been given such that the laterally elongated light distribution pattern PA formed by light irradiated from the lamp unit 10 forms the light distribution pattern PL1 for the low beam by being synthesized with the basic light distribution pattern P01 formed by light irradiated from the projector type lamp unit, a light distribution pattern PL2 for a low beam can also be formed by using the laterally elongated light distribution pattern PA shown in FIG. 5 (*a*) as it is and by synthesizing the laterally elongated light distribution pattern PA with a basic light distribution pattern P02 formed by light irradiated from a parabola type lamp unit.

According to cutoff lines CL3, CL4 of the basic light distribution pattern P02, although the opposed lane side cutoff line CL3 is similar to the opposed lane side cutoff line CL1 of the basic light distribution pattern P01, the own lane side cutoff line CL4 is extended to be long in a left skewed upper direction by an angle of inclination of 15° from the elbow point E.

According to the basic light distribution pattern P02, a hot zone HZ2 is formed to surround the elbow point E to be proximate to the left, a portion of the hot zone HZ2 disposed on the left side tends to be dark. Therefore, by additionally forming the laterally elongated light distribution pattern PA, brightnesses of two left and right side portions of the hot zone HZ2 are effectively reinforced.

Further, although according to the first exemplary embodiment, an explanation has been given such that the light emitting chip 14*a* is provided with the light emitting face of the shape of the rectangle of about 1×2 mm square, a light emitting chip having other size or shape can naturally be used.

Further, although according to the first exemplary embodiment, an explanation has been given such that the lower end edge 14*a*1 of the light emitting chip 14*a* is inclined by 15° relative to the horizontal line, the lower end edge 14*a*1 can naturally be set to other angle of inclination.

Further, although according to the lamp unit 10 according to the first exemplary embodiment, the optical axis Ax is arranged to be directed to the lower direction by about 3° relative to the axis line extended in the front and rear direction of the vehicle in order to form the laterally elongated light distribution pattern PA at vicinities of lower sides of the cutoff lines CL1, CL2 of the light distribution pattern PL1 for the low beam, instead of arranging in this way, even when the optical axis Ax is made to coincide with the axis line extended in the front and rear direction of the vehicle, thereafter, the light emitting chip 14*a* is arranged slightly on the upper side of the optical axis Ax, a laterally elongated light distribution pattern having a shape substantially the same as that of the laterally elongated light distribution pattern PA can be formed.

Further, when the lamp unit 10 according to the first exemplary embodiment is constituted to be inverted in the left and right direction relative to the optical axis Ax, a laterally elongated light distribution pattern constituted by inverting the laterally elongated light distribution pattern PA in the left and right direction can be formed. Further, when the laterally elongated light distribution pattern is formed as a portion of a light distribution pattern for a low beam of a right light distribution, operation and effect similar to those of the case of the first exemplary embodiment can be achieved.

A second exemplary embodiment of the invention will be explained.

Figure 6:
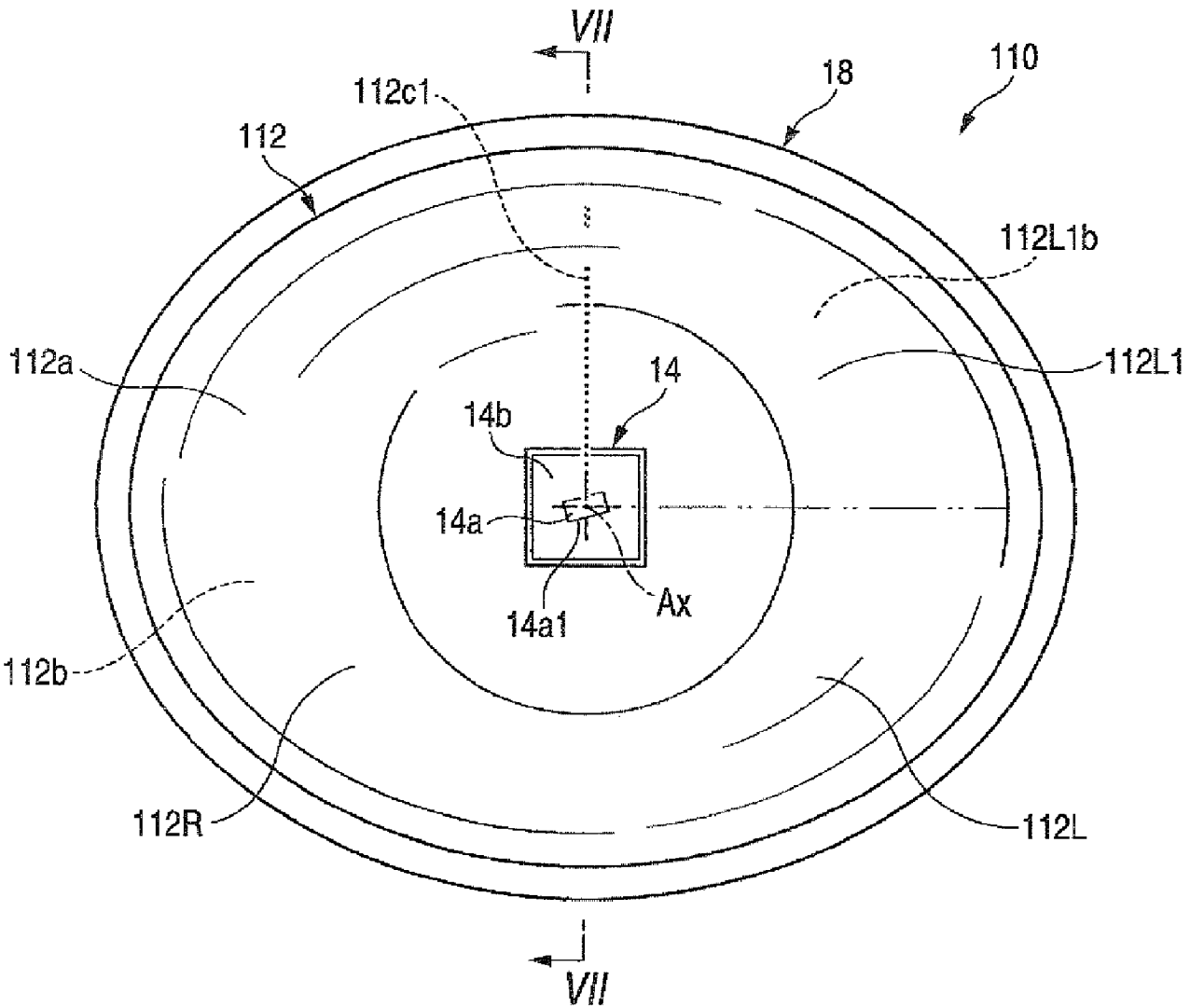
FIG. 6 is a front view showing a lamp unit of a vehicle headlamp according to a second exemplary embodiment of the invention.
Figure 7:
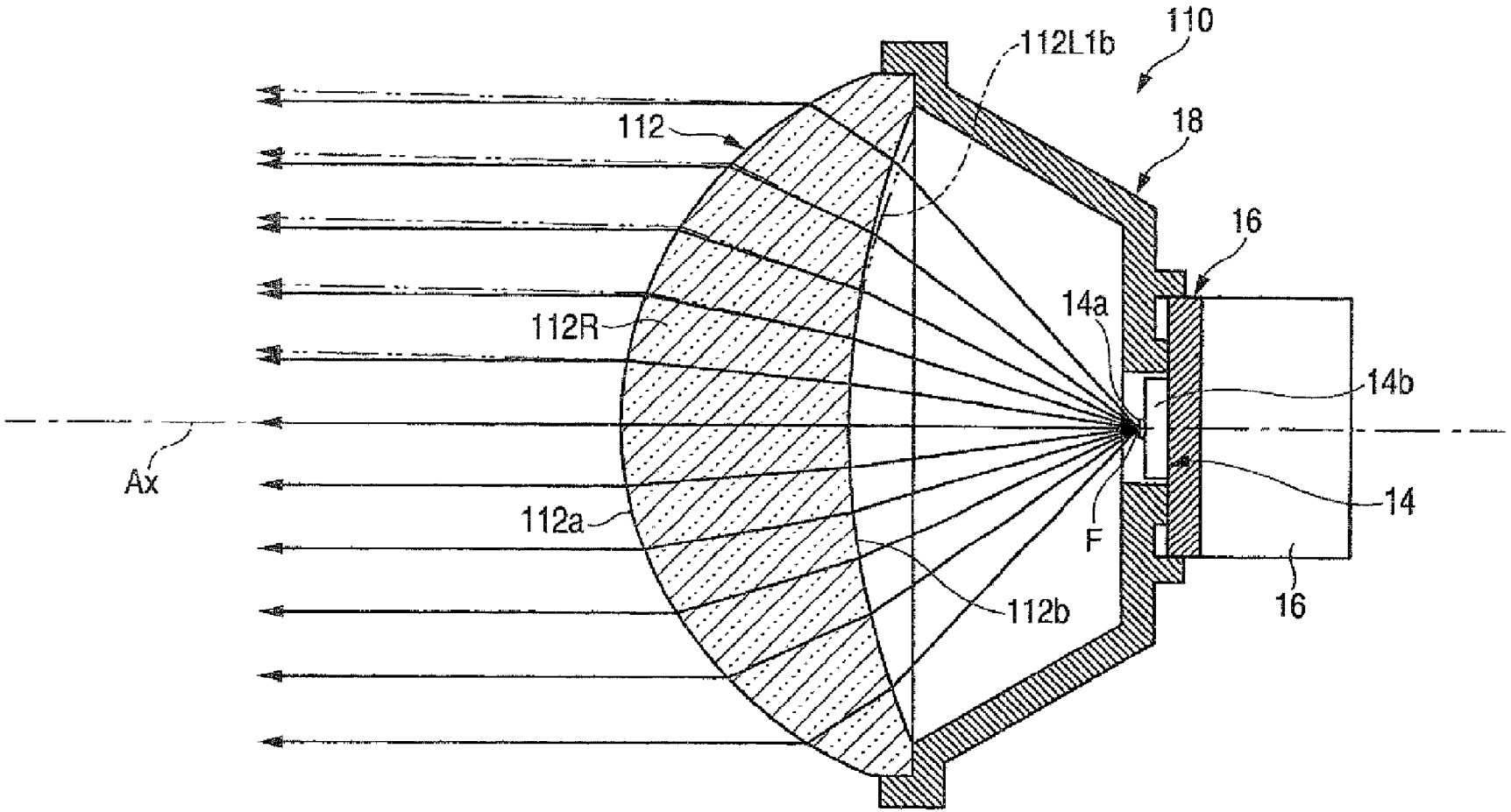
FIG. 7 is a sectional view taken along a line VII-VII of FIG. 6.

FIG. 6 is a front view showing a lamp unit 110 of a vehicle headlamp according to the second exemplary embodiment. FIG. 7 is a sectional view taken along a line VII-VII of FIG. 6.

As shown by the drawings, although a basic constitution of the lamp unit 110 according to the second exemplary embodiment is similar to that in the case of the first exemplary embodiment, a constitution of a convex lens 112 partially differs from the convex lens 12 of the first exemplary embodiment.

Also the convex lens 112 of the second exemplary embodiment is a convex meniscus lens having a convex face at a front side surface 112*a* and a concave face at a rear side surface 112*b* for emitting light from the light emitting element 14 as parallel light in a vertical face and emitting the light as diffused light to left and right sides in a horizontal face, similarly to the convex lens 12 of the above first exemplary embodiment.

However, according to the convex lens 112, in a pair of lens regions 112L, 112R on left and right sides of the optical axis Ax thereof, only a region of the left side lens region 112L disposed on the left side on an upper side of the optical axis Ax is constituted as an upper deflecting region 112L1 for deflecting the light from the light emitting element 14 in a direction upward from a direction of the right side lens region 112R by about 0.8°.

In order to realize the constitution, a portion of the rear side surface 112*b* of the convex lens 112 disposed at the upper deflecting region 112L1 is constituted as an upper deflecting face 112L1*b* having a surface shape which differs from that of other general face. The constitution of the upper deflecting face 112L1*b* is similar to that of the upper deflecting face 112L1*b* in the convex lens 12 of the first exemplary embodiment. Further, between the upper deflecting face 112L1*b* and the general face, a boundary stepped portion 112*c*1 for partitioning the upper deflecting region 112L1 and the right side lens region 112R is formed to step up from the right side lens region 112R to the upper deflecting region 112L1. Further, a boundary stepped portion is not formed between the upper deflecting region 112L1 in the left side lens region 112L and the other general region (that is, a region on a lower side of the optical axis Ax).

The light from the light emitting element 14 incident on the right side lens region 112R and the general region of the left side lens region 112L of the convex lens 112 is emitted to a front side as light in parallel with the optical axis Ax in a vertical face as shown by a bold line in FIG. 7, and the light from the light emitting element 14 incident on the upper deflecting region 112L1 of the left side lens region 112L is emitted to the front side as parallel light directed in a direction by about 0.8° relative to the optical axis Ax in the vertical face as shown by a two-dotted chain line in the drawing. Further, a light path in the horizontal face is similar to that in the case of the first exemplary embodiment.

Figure 8:
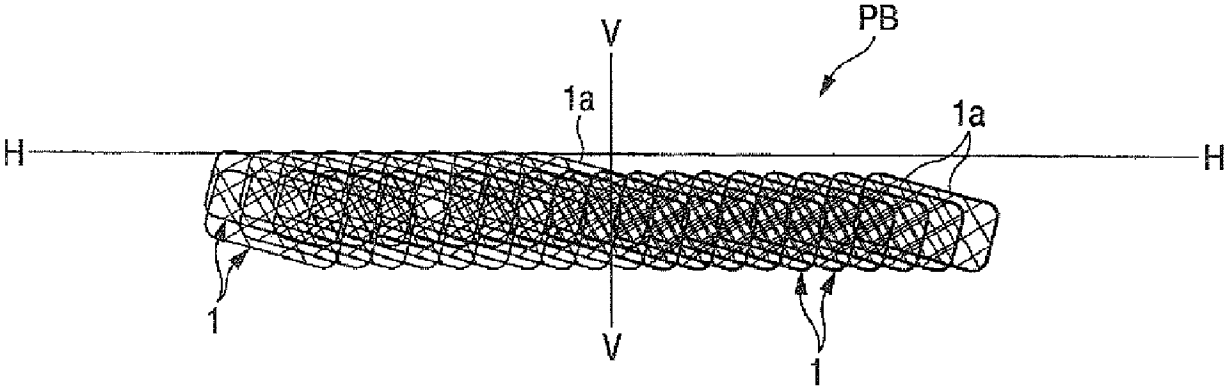
FIG. 8 (*a*) is a diagram showing a laterally elongated light distribution pattern formed on the imaginary vertical screen by light irradiated to a front side from the lamp unit according to the second exemplary embodiment, and FIG. 8 (*b*) is a diagram perspectively showing a light distribution pattern for a low beam including a portion of the laterally elongated light distribution pattern.
Figure 8:
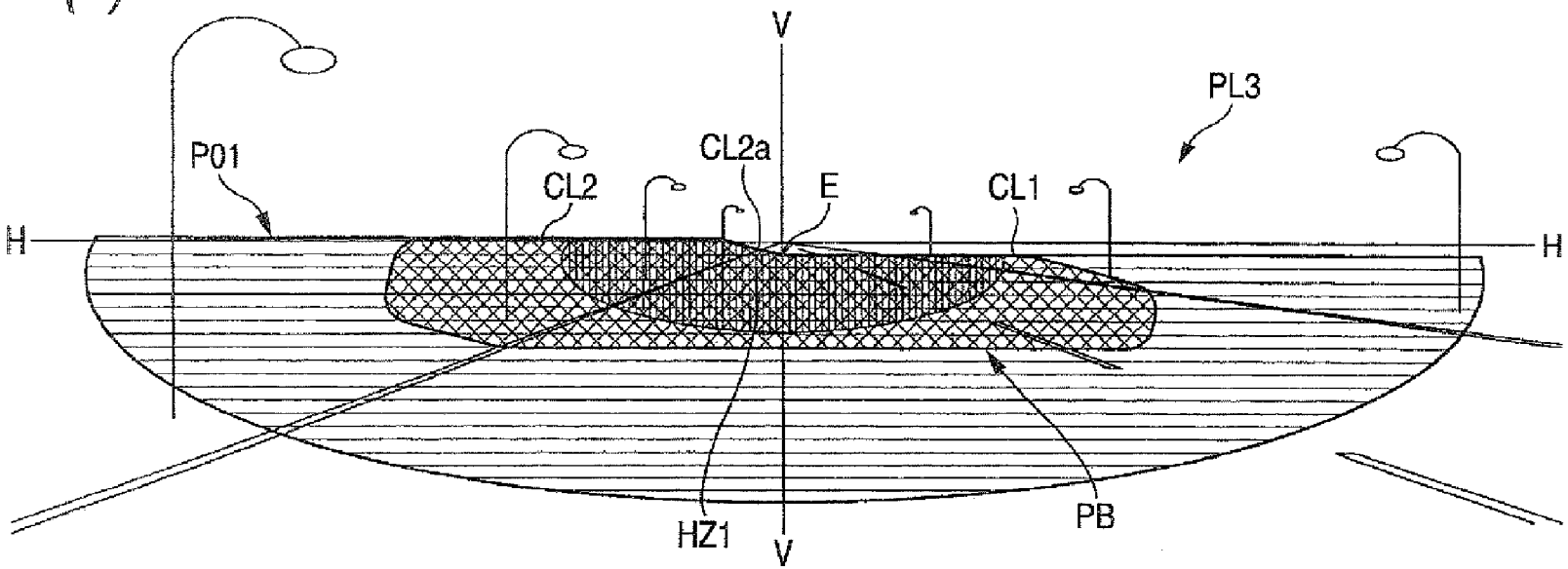

FIG. 8 (*a*) is a diagram showing a laterally elongated light distribution pattern PB formed on an imaginary vertical screen arranged at a portion 25 m frontward from the lamp by light irradiated from the lamp unit 110 according to the second exemplary embodiment. FIG. 8 (*b*) is a diagram perspectively showing a light distribution pattern PL3 for a low beam including the laterally elongated light distribution pattern PB.

As shown by FIG. 8 (*b*), the light distribution pattern PL3 for the low beam is formed as a light distribution pattern synthesized with the basic light distribution pattern P01 and the laterally elongated light distribution pattern PB. In this case, the basic light distribution pattern P01 is similar to that in the case of the first exemplary embodiment.

As shown by FIG. 8 (*a*), similar to the laterally elongated light distribution pattern PA shown in FIG. 4 (*a*), the laterally elongated light distribution pattern PB is provided with a shape of expanding the light source image I invertedly projected by the convex lens 112 in a left and right direction.

However, a portion of the laterally elongated light distribution pattern PB disposed on a left side of a portion thereof disposed on a right side of V-V line is not displaced as in the case of the laterally elongated light distribution pattern PA but is expanded to an upper side. That is, although a portion of an upper end of the portion disposed on the left side is displaced to an upper side by about 0.8° more than an upper end edge of the portion disposed on the right side, a position of a lower end edge thereof is disposed at a height the same as that of a lower end edge of the portion disposed on the right side. This is because only a half of light emitted from the left side lens region 112L of the convex lens 112 is directed to the upper side by about 0.8° relative to light emitted from the right side lens region 12R.

Even when the constitution of the second exemplary embodiment is adopted, after irradiating the vehicle front side road face widely in the width, a region on a side of own lane can remotely be irradiated, thereby, a remote optical recognizability of the low beam can sufficiently be promoted.

In this case, although a brightness of the portion of the laterally elongated light distribution pattern PB disposed on the left side of V-V line is reduced by an amount of being expanded more or less in an up and down direction more than in the case of the laterally elongated light distribution pattern PA, a position of the lower end edge coincides with the lower end edge of the portion disposed on the right side. Therefore, brightnesses of two left and right side portions of a hot zone HZ1 can sufficiently be reinforced, and a nonuniformity in a light distribution can be made to be difficult to be brought about at the vehicle front road face.

Further, even in a case of constituting only a region on a lower side of the optical axis Ax as an upper deflecting region as in the second exemplary embodiment instead of constituting only the region on the upper side of the optical axis Ax in the left side lens region 112L of the convex lens 112 as the upper deflecting region 112L1, operation and effect similar to those of the second exemplary embodiment can be achieved.

A third embodiment of the invention will be explained.

Figure 9:
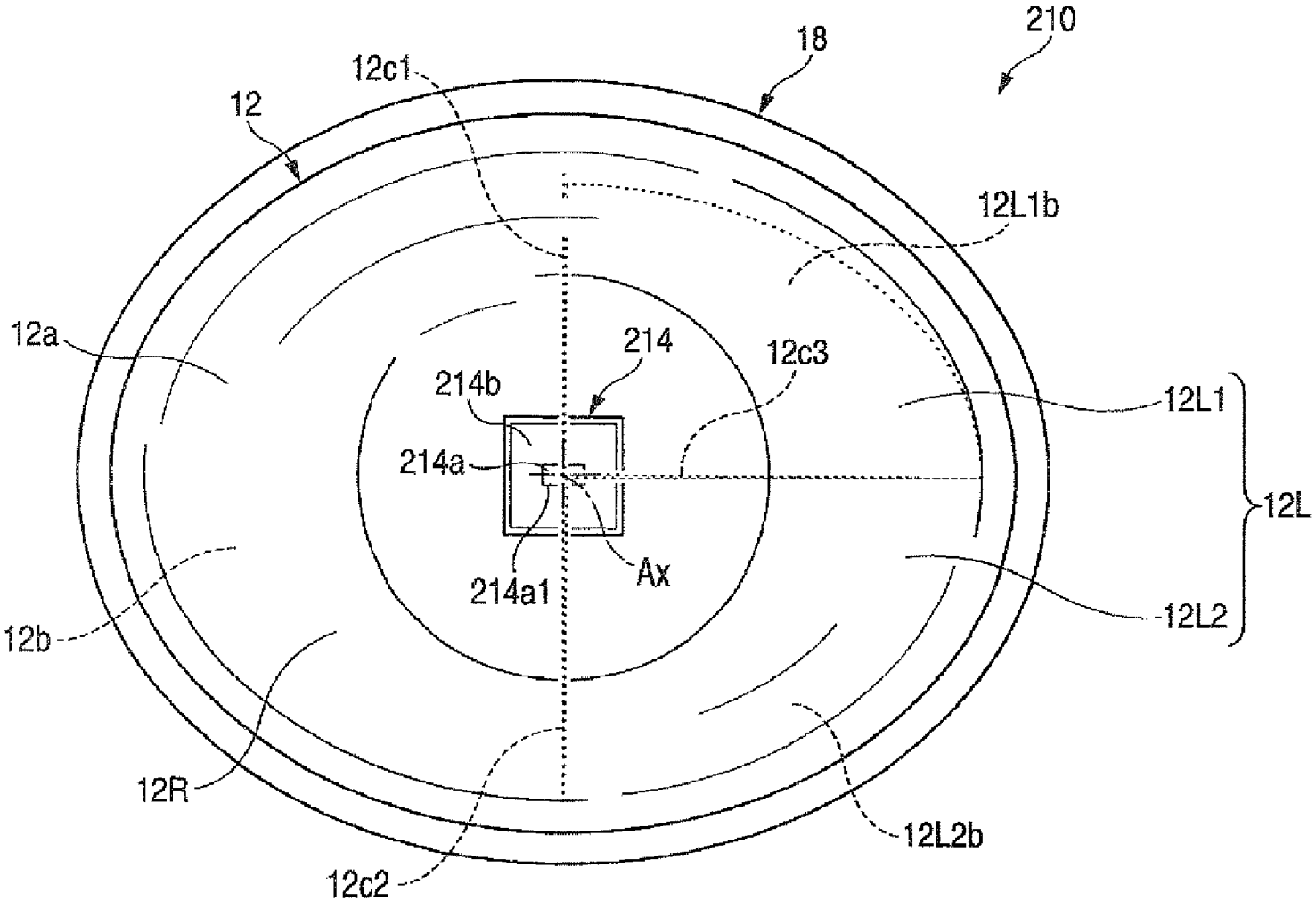
FIG. 9 is a front view showing a lamp unit of a vehicle headlamp according to a third embodiment of the invention.

FIG. 9 is a front view showing a lamp unit 210 of a vehicle headlamp according to the third exemplary embodiment.

As shown by the drawing, although a basic constitution of the lamp unit 210 according to the third exemplary embodiment is similar to that in the case of the first exemplary embodiment, a constitution of a light emitting element 214 partially differs from the light emitting element 14 of the first exemplary embodiment. Further, the lamp unit 210 is used in a state of directing the optical axis Ax to a left side by about 2 through 3° more than in the case of the first exemplary embodiment (that is, a state of being directed to a lower side by about 3° relative to an axis line extended in a front and rear direction of a vehicle and directed to a left side by about 2 through 3°).

Also the light emitting element 214 of the third exemplary embodiment is a white light emitting diode and comprises a light emitting chip 214*a* having a light emitting face in a rectangular shape of about 1×2 mm square. A board 214*b* in a square shape for supporting the light emitting chip 214*a*, and the light emitting chip 214*a* is mounted to the board 214*b* in a state of being arranged horizontally without rotating the light emitting chip 214*a*. Further, the light emitting element 214 is arranged such that a lower end edge 214*a*1 of the light emitting chip 214*a* becomes horizontal.

Figure 10:
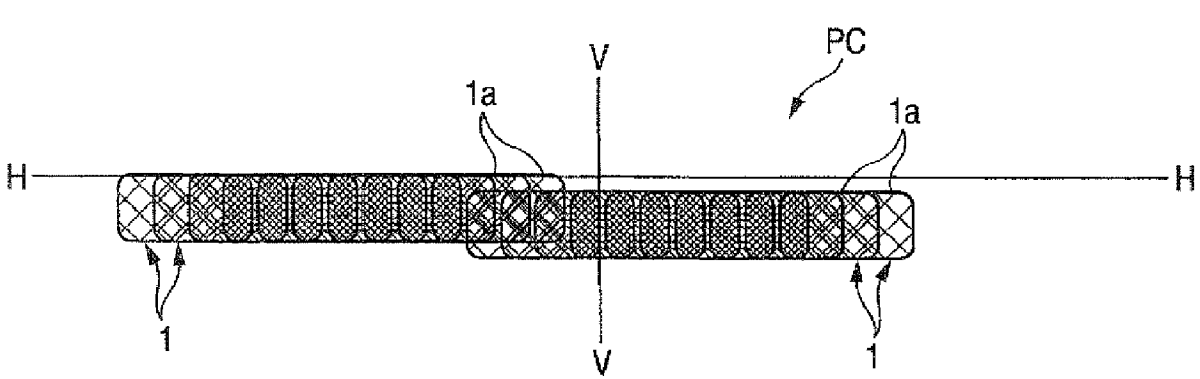
FIG. 10 (*a*) is a diagram showing a laterally elongated light distribution pattern formed on the imaginary vertical screen by light irradiated to a front side from the lamp unit according to the third embodiment, and FIG. 10 (*b*) is a diagram perspectively showing a light distribution pattern for a low beam including the laterally elongated light distribution pattern at a portion thereof.
Figure 10:
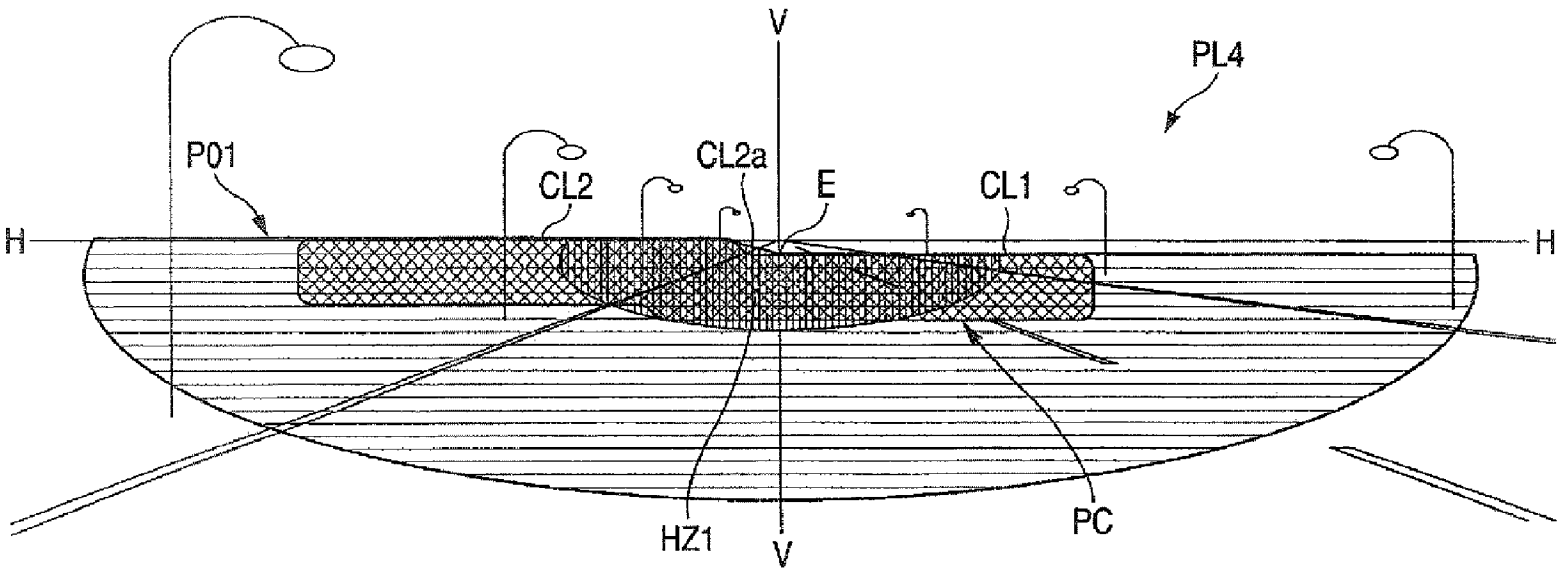

FIG. 10 (*a*) is a view showing a laterally elongated light distribution pattern PC at a position 25 m frontward from the lamp by light irradiated to a front side from the lamp unit 210 according to the third exemplary embodiment. FIG. 10 (*b*) is a view perspectively showing a light distribution pattern PL4 for a low beam including the laterally elongated light distribution pattern PC at a portion thereof.

As shown by FIG. 10 (*b*), the light distribution pattern PL4 for the low beam is formed as a light distribution pattern synthesized with the basic light distribution pattern P01 and the laterally elongated light distribution pattern PC. In that case, the basic light distribution pattern P01 is similar to that of the case of the first exemplary embodiment.

The laterally elongated light distribution pattern PC is formed to slenderly extend to left and right sides centering on a vertical line on a left side of V-V line by about 2 through 3°, and an upper end edge is extended along the cutoff lines CL1, CL2. Further, by forming the laterally elongated light distribution pattern PC additionally to the basic light distribution pattern P01, brightnesses of the hot zone HZ1 and two left and right side portions thereof are reinforced.

As shown by FIG. 10 (*a*), the laterally elongated light distribution pattern PC is provided with a shape of expanding the light source image I invertedly projected by the convex lens 112 in the left and right direction similar to the laterally elongated light distribution pattern PA shown in FIG. 4 (*a*). A portion thereof disposed on the left side is displaced on the upper side by about 0.8° relative to a portion disposed on a right side of the vertical line on the left side of V-V line by about 2 through 3°.

However, the laterally elongated light distribution pattern PC is formed by a width in an up and down direction narrower than that of the laterally elongated light distribution pattern PA. This is because the light emitting chip 214*a* is arranged horizontally by a laterally elongated arrangement. Thereby, also respective light source images I are arranged horizontally in a laterally elongated arrangement. In that case, the upper end edges Ia of the respective light source images I are formed to align on the same horizontal line, and therefore, the laterally elongated light distribution pattern PC is formed such that the upper end edge is provided with a high bright/dark ratio.

Also in the case of adopting the constitution of the embodiment, after irradiating the vehicle front road face widely in the width, the region on the side of the own lane can remotely be irradiated, thereby, the remote optical recognizability of the low beam can sufficiently be promoted.

In that case, the laterally elongated light distribution pattern PC is formed by the width in the up and down direction narrower than that of the laterally elongated light distribution pattern PA. Therefore, the laterally elongated light distribution pattern PC is formed as a bright light distribution pattern. The upper end edge is provided with the high bright/dark ratio. Therefore, the brightnesses at the vicinities of the cutoff lines CL1, CL2 in the light distribution pattern PL4 for the low beam can further be increased.

Further, according to the third exemplary embodiment, the light emitting chip 214*a* of the light emitting element 214 is arranged horizontally. Therefore, a stepped portion at an upper end edge of the laterally elongated light distribution pattern PC cannot be formed as an inclined portion as in the laterally elongated light distribution pattern PA. Therefore, although a brightness of a region at a vicinity of the elbow point E in the hot zone HZ1 of the light distribution pattern PL4 for the low beam cannot sufficiently be reinforced, brightnesses of two left and right side portions of the hot zone HZ1 can sufficiently be reinforced by the light distribution pattern PL4.

Further, although the stepped portion of the upper end edge of the laterally elongated light distribution pattern PC is not formed as the inclined portion, the stepped portion is displaced to the left side by about 2 through 3° relative to V-V line. Therefore, a portion of the laterally elongated light distribution pattern PC does not generate glare light by being extruded to an upper side from a skewed rise portion CL2*a* of the cutoff line CL2 on the own lane side of the light distribution pattern PL4 for the low beam.

A light distribution pattern for a low beam can also be formed by synthesizing the laterally elongated light distribution pattern PC formed by light irradiated from the lamp unit 210 according to the third exemplary embodiment and the basic light distribution pattern P02 formed by light irradiated from the lamp unit of a parabola type as shown by FIG. 5 (*b*).

When the lamp unit 210 according to the third exemplary embodiment and the lamp unit 10 according to the first exemplary embodiment are combined to use, brightnesses at vicinities of the cutoff lines CL1, CL2 in the light distribution pattern PL1 (or PL4) for the low beam can be increased over a wide range. Further, the cutoff lines CL1, CL2 per se can also be formed by light irradiated from the two lamp units 10, 210.

A fourth embodiment of the invention will be explained.

Figure 11:
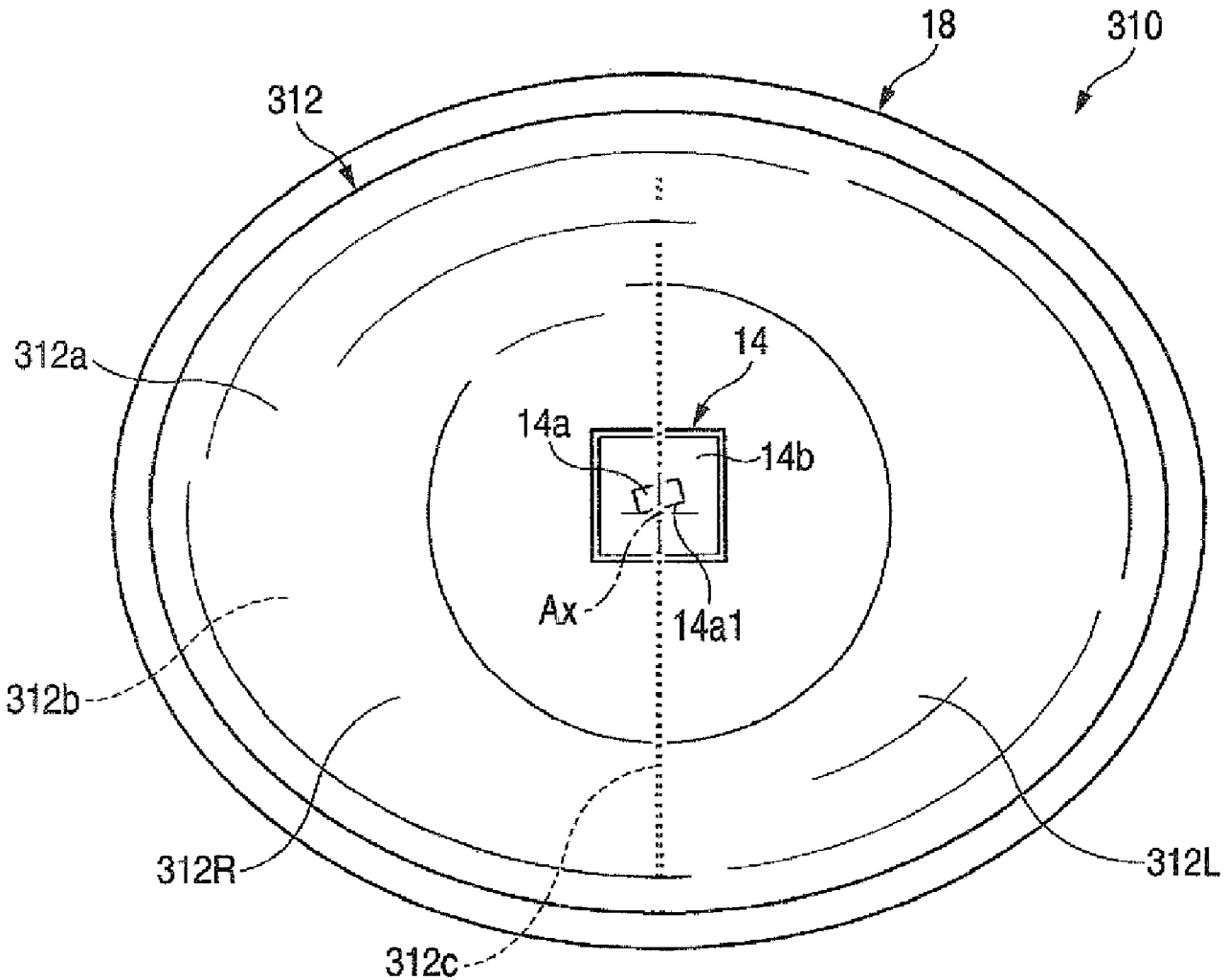
FIG. 11 is a front view showing a lamp unit of a vehicle headlamp according to a fourth embodiment of the invention.

FIG. 11 is a front view showing a lamp unit 310 of a vehicle headlamp according to the fourth exemplary embodiment.

As shown by the drawing, although a basic constitution of the lamp unit 310 according to the fourth exemplary embodiment is similar to that in the case of the first exemplary embodiment, a position of the light emitting element 14 and a constitution of a convex lens 312 partially differ from those of the case of the first exemplary embodiment.

According to the fourth exemplary embodiment, the light emitting element 14 is arranged at a position slightly displaced to an upper side from the optical axis Ax. Specifically, a corner portion of the light emitting chip 14*a* disposed at a lowermost end thereof (that is, a right end portion of the lower end edge 14*a*1 extended to a left upper side by 15° relative to the horizontal line) is arranged to dispose in a horizontal face including the optical axis Ax.

Similar to the convex lens 12 of the first exemplary embodiment, also the convex lens 312 of the fourth exemplary embodiment is a convex meniscus lens having a front side surface 312*a* in a convex face and a rear side surface 312*b* in a concave face for emitting light from the light emitting element 14 as parallel light in a vertical face and emitting the light as diffused light to left and right sides in a horizontal face. Further, in a pair of lens regions 312L, 312R from left and right sides of the optical axis Ax in the convex lens 312, the left side lens region 312L is constituted as an upper deflecting region for deflecting light from the light emitting element 14 to an upper side more than the right side lens region 312R.

However, according to the fourth exemplary embodiment, the left side lens region 312L emits the light from the light emitting element 14 in parallel with the optical axis Ax in a vertical face, and the right side lens region 312R reflects the light from the light emitting element 14 to a lower side by about 0.8° relative to the optical axis Ax in a vertical face.

In order to realize the constitution, a portion of the rear side surface 312*b* of the convex lens 312 disposed at the right side lens region 312R is provided with a surface shape different from that of the portion disposed at the left side lens region 312L and a boundary stepped portion 312*c* is formed therebetween.

Even when the constitution of the fourth exemplary embodiment is adopted, the laterally elongated light distribution pattern PA substantially similar to the laterally elongated light distribution pattern PA shown in FIG. 4 (*a*) can be formed.

Particularly, according to the fourth exemplary embodiment, the light emitting element 14 is arranged such that a corner portion disposed at a lowermost end of the light emitting chip 14*a* is disposed on a horizontal face including the optical axis Ax. Therefore, upper end edge corner portions of the light source images I invertedly projected by the left side lens region 312L of the convex lens 312 can be aligned on H-H line on the left side of V-V line, and upper end edge corner portions of the light source images I invertedly projected by the right side lens region 312R of the convex lens 312 can be aligned at a position on a lower side by about 0.8° from H-H line on a right side of V-V line.

Therefore, a laterally elongated light distribution pattern formed by light irradiated from the lamp unit 310 according to the fourth exemplary embodiment can accurately be formed along the cutoff lines CL1, CL2 after preventing the laterally elongated light distribution pattern from being extruded to an upper side from the cutoff lines CL1, CL2 of the basic light distribution pattern P01 shown in FIG. 4 (*b*).

Further, in this way, according to the fourth exemplary embodiment, a position of an upper end edge of the laterally elongated light distribution pattern is accurately rectified by a position of an upper end edge corner portion of the light source image I. Therefore, even when an amount of deflecting light from the light emitting element 14 to a lower side by the right side lens region 312R is set to a value smaller than about 0.8° (for example, 0.57°), the laterally elongated light distribution pattern can be prevented from being extruded to the upper side from the cutoff lines CL1, CL2 of the basic light distribution pattern P01. Thereby, a degree of making the upper end edge of the laterally elongated light distribution pattern and the cutoff lines CL1, CL2 coincide with each other can be promoted.

Further, in the light emitting element 14 of the fourth exemplary embodiment, a distance from the lower end edge 14*a*1 of the light emitting chip 14*a* from the optical axis Ax is made to be shorter than that in the case of the first exemplary embodiment. Therefore, a clearness degree of the upper end edge Ia of the light source image I is further promoted than in the case of the first exemplary embodiment. Thereby, a bright/dark ratio of a stepped portion in the laterally elongated light distribution pattern can further be promoted.

Further, numerical values shown as various elements in the respective embodiments are only examples, the numerical values may naturally be set to pertinently different values.

It will be apparent to those skilled in the art that various modifications and variations can be made to the described exemplary embodiments of the present invention without departing from the spirit or scope of the invention. Thus, it is intended that the present invention cover all modifications and variations of this invention consistent with the scope of the appended claims and their equivalents.

What is claimed is:

1. A lamp unit of a vehicle headlamp comprising:

a convex lens arranged on an optical axis extending in a front and rear direction of the lamp unit; and a light source arranged rearward from the convex lens, wherein direct emitting light from the light source to the convex lens is emitted toward a front side of the lamp unit, wherein the convex lens is configured to emit the light from the light source as substantially parallel light in a vertical face and emit as light diffused to left and right sides in a horizontal face, the convex lens comprises a pair of lens regions on left and right sides of the optical axis of the convex lens, at least a partial region of one of the lens regions is configured as an upper deflecting region that deflects the light in a direction further upwards than a direction of light emitted from the other of the lens regions, and wherein the convex lens comprises a boundary stepped portion extending in a vertical direction, and the boundary stepped portion partitions the convex lens into the upper deflecting region and the other of the lens regions.

2. The lamp unit according to claim 1, wherein the boundary stepped portion is formed on a rear side surface of the convex lens.

3. The lamp unit according to claim 2, wherein the boundary stepped portion is formed to be stepped up from the other of the lens regions to the upper deflecting region.

4. The lamp unit according to claim 1, wherein the light source comprises a light emitting element including a light emitting chip with a lower end edge formed linearly.

5. The lamp unit according to claim 4, wherein the lower end edge of the light emitting chip is arranged to incline by a predetermined angle to be arranged further upwards from the other lens region to the one lens region.

6. The lamp unit according to claim 4, wherein the light emitting chip has a rectangular outer shape.

7. The lamp unit according to claim 1, wherein the convex lens further comprises a concave rear surface.

8. The lamp unit according to claim 1, wherein a focal point of the convex lens in the vertical face is positioned on the light source.

9. The lamp unit according to claim 1, wherein the direct emitting light is emitted from both lens regions.

10. The lamp unit according to claim 1, wherein the light emitted from the other of the lens regions is parallel to the optical axis of the lens.

11. The lamp unit according to claim 1, wherein each of the pair of lens regions is disposed on both sides of the horizontal axis of the lens.

* * * * *